US008028741B2

(12) United States Patent
Rees et al.

(10) Patent No.: US 8,028,741 B2
(45) Date of Patent: Oct. 4, 2011

(54) STRIP CASTING APPARATUS WITH IMPROVED SIDE DAM FORCE CONTROL

(75) Inventors: Harold Bradley Rees, Ladoga, IN (US); Nikolco S. Nikolovski, Figtree (AU)

(73) Assignee: Nucor Corporation, Charlotte, NC (US)

( * ) Notice: Subject to any disclaimer, the term of this patent is extended or adjusted under 35 U.S.C. 154(b) by 133 days.

(21) Appl. No.: 12/266,206

(22) Filed: Nov. 6, 2008

(65) Prior Publication Data

US 2010/0108286 A1 May 6, 2010

(51) Int. Cl.
*B22D 11/06* (2006.01)

(52) U.S. Cl. ..... 164/480; 164/428

(58) Field of Classification Search ..... 164/480, 164/428

See application file for complete search history.

(56) References Cited

U.S. PATENT DOCUMENTS

| | | | | |
|---|---|---|---|---|
| 4,694,899 | A | 9/1987 | Wood et al. | |
| 5,201,362 | A * | 4/1993 | Yamagami et al. | 164/480 |
| 5,927,375 | A * | 7/1999 | Damasse et al. | 164/451 |
| 2007/0267168 | A1 | 11/2007 | Schueren | |

FOREIGN PATENT DOCUMENTS

| | | |
|---|---|---|
| EP | 546206 | 7/1997 |
| JP | 63-177944 | 7/1988 |
| KR | 100333064 | 4/2002 |
| WO | 2008025054 | 3/2008 |

OTHER PUBLICATIONS

International-Type Search Report in AU2008906487, dated Jan. 14, 2009.

* cited by examiner

*Primary Examiner* — Kevin P Kerns
(74) *Attorney, Agent, or Firm* — Hahn, Loeser & Parks LLP; Arland T. Stein

(57) ABSTRACT

Apparatus for continuously casting metal strip includes a pair of counter-rotatable casting rolls laterally positioned to form a nip therebetween through which thin strip can be cast, a pair of confining side dams adjacent the ends of the casting rolls capable of confining a casting pool of molten metal supported on the casting rolls and formed on the casting surfaces above the nip, a metal delivery system disposed above the nip and capable of discharging molten metal to form the casting pool supported on the casting rolls, side dam actuators each capable of applying cyclical axial force to the side dams without leakage, and a control system capable of actuating at least one side dam actuator to cyclically vary the apply force of the side dam against the ends of the casting rolls during a casting campaign.

20 Claims, 8 Drawing Sheets

STRIP CASTING APPARATUS WITH IMPROVED SIDE DAM FORCE CONTROL

This invention relates in general to continuous casting of thin metal strip by a twin roll caster.

In a twin roll caster molten metal is introduced between a pair of counter-rotated horizontal casting rolls that are cooled so that metal shells solidify on the moving roll surfaces, and are brought together at a nip between them to produce a solidified strip product delivered downwardly from the nip between the rolls. The term "nip" is used herein to refer to the general region at which the rolls are closest together. The molten metal may be poured from a ladle into a smaller vessel or series of smaller vessels from which it flows through a metal delivery nozzle or series of delivery nozzles (also called the "core nozzles") located above the nip, forming a casting pool of molten metal supported on the casting surfaces of the rolls immediately above the nip and extending along the length of the nip. This casting pool is usually confined between side plates or dams held in sliding engagement with end surfaces of the casting rolls so as to dam the two ends of the casting pool against outflow.

Further, the twin roll caster may be capable of continuously producing cast strip from molten steel through a sequence of ladles. Pouring the molten metal from the ladle into a smaller vessel before flowing through the metal delivery nozzle enables the exchange of an empty ladle with a full ladle without disrupting the production of cast strip.

During operation, the metal flow rate and molten metal temperature in the area where the side dams, casting rolls and meniscus of the casting pool intersect, i.e. the "triple point" area or region, is controlled. Notably, the distance between the side dams and the ends of the delivery nozzles nearest the side dams should be controlled and maintained to prevent the formation of unwanted steel skulls either on the side dam or delivery nozzle.

Apparatus and method for controlling and maintaining a set distance between the outer ends of the delivery nozzles and the side dams during a campaign is disclosed in U.S. Pat. Nos. 6,910,523, 6,588,492, and 7,147,035. The apparatus and method disclosed has a carriage assembly for commonly supporting the side dams and nearest delivery nozzles to maintain distance between the side dams and ends of the delivery nozzles at a set distance with wear of the side dams. The delivery nozzles could be moved relative to the side dams by the carriage assembly. The movement also involved simultaneously moving of both delivery nozzle and the adjacent side dam to maintain the distance between the side dam and end of the delivery nozzle. This movement affects the side dam force and thus side dam wear. Further, the movement of the side dam by the support to compensate for wear of the side dam required repositioning of the delivery nozzle to maintain the distance between the side dam and the end of the nearest delivery nozzle.

Alternatively, as further described below, an apparatus and method for controlling the position of the side dam to reduce the depth of the groove cut in the bottom of the side dam by strip exiting the nip while the side dam wear is maintained low. If the groove is too deep, steel leakage may occur resulting in the need to terminate the cast, and on the other hand, if the groove is too shallow excessive side dam wear will occur resulting in shorter casting campaigns. One of the main factors that can prevent accurate side dam position/force control is the effect of stiction in the side dam apply cylinders Solidified skulls may form from time to time on the side dam and also the delivery nozzle when the distance between the side dam and nozzle is not maintained. When these skulls drop into the roll nip, they cause the two solidifying shells at the casting roll nip to separate and "swallow" additional liquid steel between the shells causing the strip surface to reheat and causing the strip to break thus disrupting the continuous production of coiled strip. The dropped skulls at the nip are known as "snake eggs" and are detected as horizontal force spikes on the side dams at the roll nip, as well as visible bright bands across the width of the strip. Snake eggs also may apply resistive forces against the side dam in addition to the forces generated by the ferrostatic head in the cast pool, and can thus cause the side dam to lift from the casting roll edge resulting in the leakage of steel between the side dam and the casting roll necessitating termination of the casting campaign. Additionally, snake eggs passing through the nip between the casting rolls can cause horizontal movement of the casting rolls and also cause movement in the side dams. To resist the increased forces generated by the snake eggs and the stiction of the side dam apply cylinders, the side dams are typically applied to the casting rolls with higher forces.

We have found that improved side dam control and a reduction of snake eggs can be achieved by cyclically varying the axial force of the side dams during a casting campaign. The improved side dam control has been found to allow for more accurate, smoother control of the side dam position, and application force which has resulted in reduced side dam wear and increased side dam life. Cyclically varying the force has also led to lower average forces which has reduced the degree of cooling of the side dams by the casting rolls thus reducing the frequency of snake eggs. The improved control over triple point pouring that results has led to a reduction in the incidence of snake eggs.

Disclosed is a method for casting metal strip comprising:

(a) assembling a pair of counter-rotatable casting rolls to form a nip therebetween through which thin strip can be cast, and a pair of confining side dams adjacent the ends of the casting rolls capable of confining a casting pool of molten metal supported on the casting rolls above the nip;

(b) assembling a metal delivery system disposed above the nip and capable of discharging molten metal to form the casting pool supported on the casting rolls;

(c) assembling side dam actuators each capable of cyclic axial movement of the side dams, and (d) controlling at least one the side dam actuator to cyclically vary the force at a cycle of at least 0.5 Hz on the side dam against the ends of the casting rolls in a direction along the axes of rotation of the casting rolls without leakage during a casting campaign.

The force on the side dams may be at a constant or a variable frequency during the casting campaign. The force on the side dams may, for example, at a variable or constant cycle of at least 0.5 Hz, at least 3.0 Hz, at least 5.0 Hz, at least 9.0 Hz, or more. Additionally, the apply force on the side dams may be varied by at least plus or minus 10% of the mean force whether constant or variable cycle is intended. Also, the typical apply force on the side dams may be varied by less than plus or minus 120 N or less.

Also disclosed is an apparatus for continuously casting metal strip comprising:

(a) a pair of counter-rotatable casting rolls laterally positioned to form a nip therebetween through which thin strip can be cast;

(b) a pair of confining side dams adjacent the ends of the casting rolls capable of confining a casting pool of molten metal supported on the casting rolls above the nip;

(c)a metal delivery system disposed above the nip and capable of discharging molten metal to form the casting pool supported on the casting rolls;

(d) side dam actuators each capable of applying cyclical axial force to the side dams of at least 0.5 Hz without leakage; and (e) a control system capable of actuating at least one side dam actuator to cyclically vary the apply force of the side dam against the ends of the casting rolls during a casting campaign.

The control system may be capable of varying the force on the side dams, for example, at a cycle of at least 0.5 Hz, at least 3.0 Hz, at least 5.0 Hz, at least 9.0 Hz, or even more. Further, the control system may be capable of varying the force on the side dams at a variable frequency or maintaining the frequency constant. Additionally, whether the frequency is variable or constant, the control system may be capable of varying the apply force on the side dams by at least plus or minus 10% of the mean force. Also, the control system may be capable of varying the apply force on the side dams by less than plus or minus 120 N or even less.

Various aspects of this invention will become apparent from the following detailed description and accompanying drawings.

DETAILED DESCRIPTION OF THE PREFERRED EMBODIMENT

Figure 1:
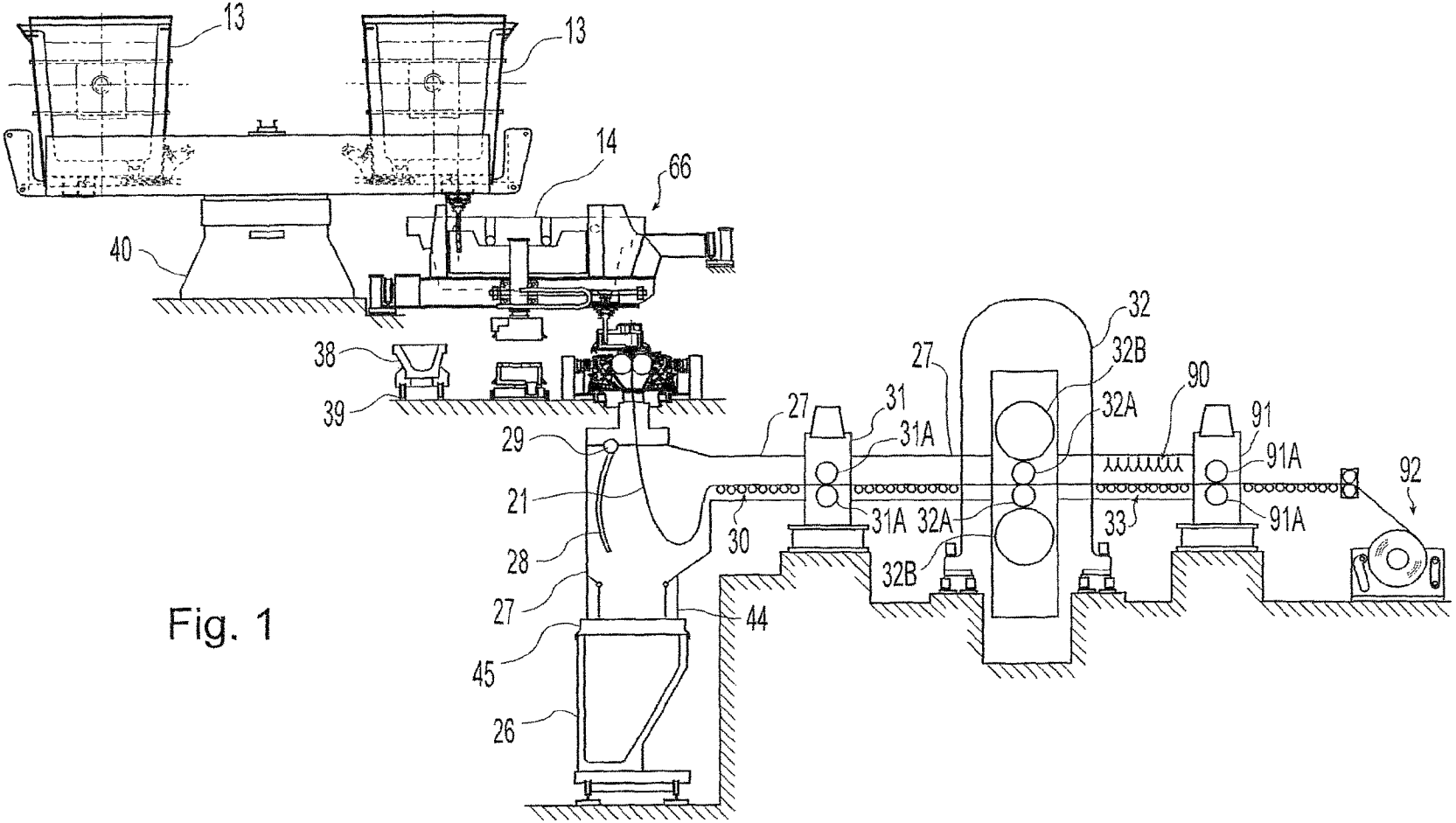
FIG. 1 is a diagrammatical side view of a portion of twin roll caster of the present disclosure.
Figure 2:
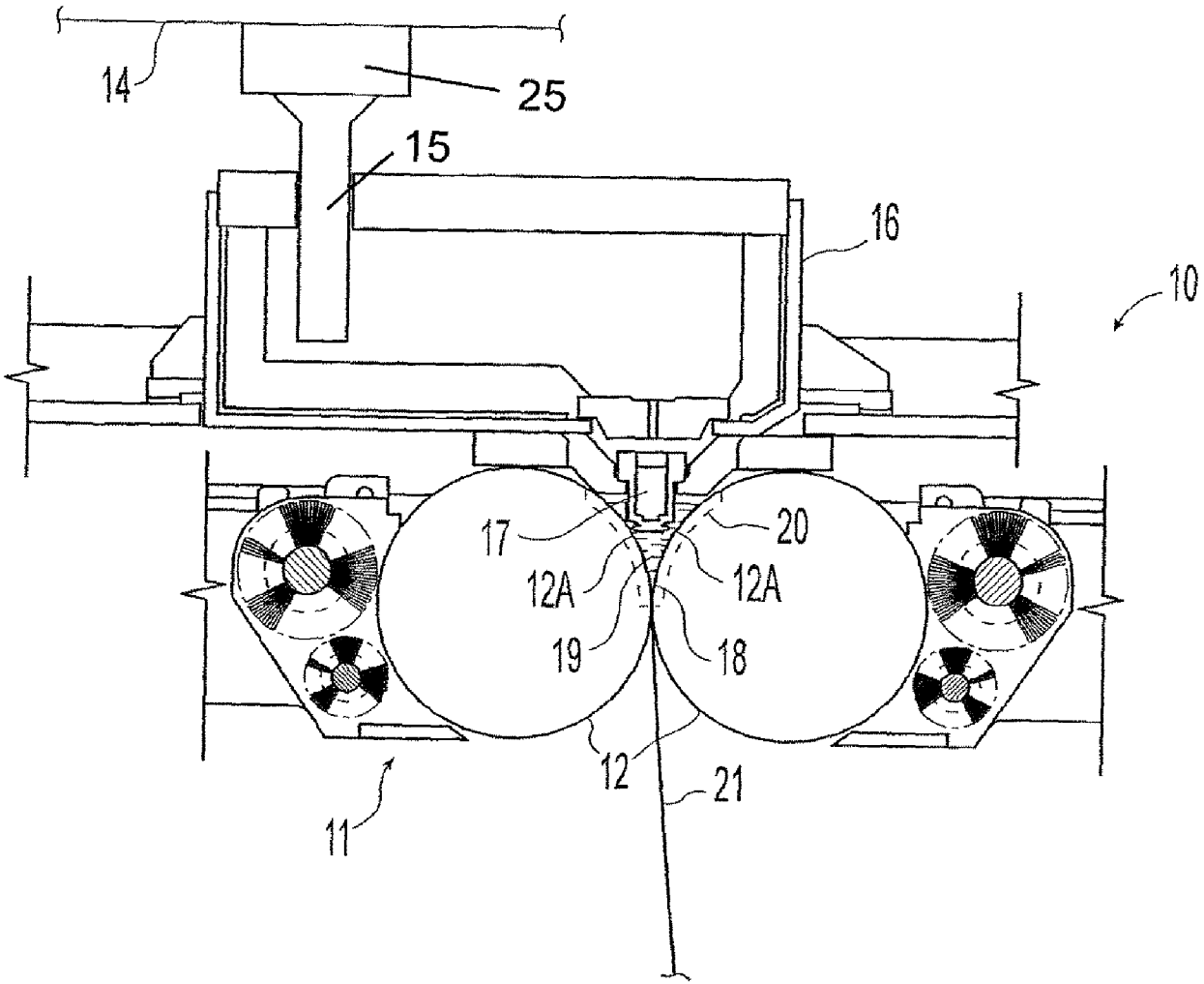
FIG. 2 is a partial sectional view through the casting rolls mounted in a roll cassette in the casting position of the caster of FIG. 1.
Figure 3:
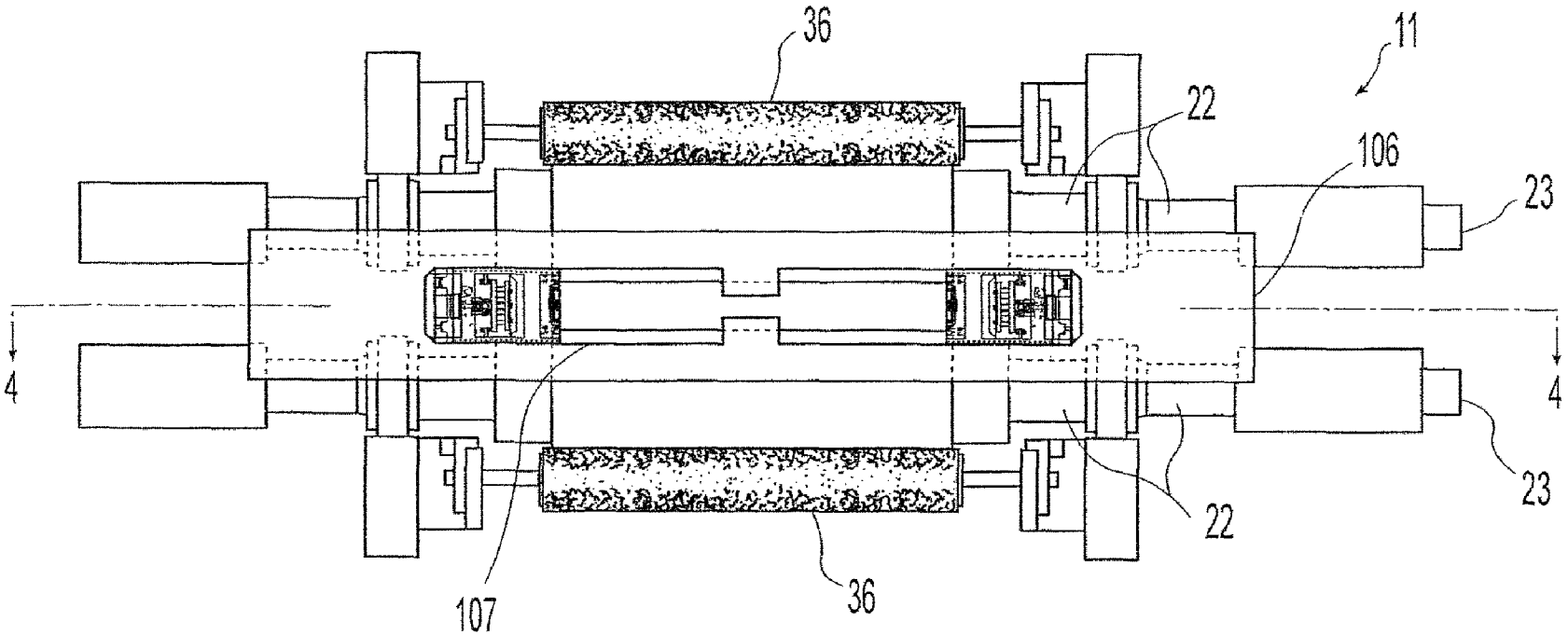
FIG. 3 is diagrammatical plan view of the roll cassette of FIG. 2 removed from the caster.

Referring now to the drawings, there is illustrated in FIGS. 1 and 2 a portion of a twin roll caster for continuously casting thin steel strip that comprises a main machine frame 10 that stands up from the factory floor and supports a roll cassette module 11 including a pair of counter-rotatable casting rolls 12 mounted therein. The casting rolls 12 having casting surfaces 12A laterally positioned to form a nip 18 therebetween. The casting rolls 12 are mounted in the roll cassette 11 for ease of operation and movement. The roll cassette facilitates rapid movement of the casting rolls ready for casting from a setup position into an operative casting position in the caster as a unit, and ready removal of the casting rolls from the casting position when the casting rolls are to be replaced. There is no particular configuration of the roll cassette that is desired, so long as it performs that function of facilitating movement and positioning of the casting rolls.

Molten metal is supplied from a ladle 13 through a metal delivery system, such as a movable tundish 14 and a transition piece or distributor 16. From the distributor 16, the molten metal flows to at least one metal delivery nozzle 17, or core nozzle, positioned between the casting rolls 12 above the nip 18. Molten metal discharged from the delivery nozzle 17 thus delivered forms a casting pool 19 of molten metal above the nip 18 supported on the casting surfaces 12A of the casting rolls 12. This casting pool 19 is confined in the casting area at the ends of the casting rolls 12 by a pair of side closures or confining plate side dams 20 (shown in dotted line in FIG. 2). The upper surface of the casting pool 19 (generally referred to as the "meniscus" level) may rise above the bottom portion of the delivery nozzle 17 so that the lower part of the delivery nozzle 17 is immersed in the casting pool 19. The casting area includes the addition of a protective atmosphere above the casting pool 19 to inhibit oxidation of the molten metal in the casting area.

The ladle 13 typically is of a conventional construction supported on a rotating turret 40. For metal delivery, the ladle 13 is positioned over a movable tundish 14 in the casting position to fill the tundish with molten metal. The movable tundish 14 may be positioned on a tundish car 66 capable of transferring the tundish from a heating station (not shown), where the tundish is heated to near a casting temperature, to the casting position. A tundish guide, such as rails, may be positioned beneath the tundish car 66 to enable moving the movable tundish 14 from the heating station to the casting position.

The movable tundish 14 may be fitted with a slide gate 25, actuable by a servo mechanism, to allow molten metal to flow from the tundish 14 through the slide gate 25, and then through a refractory outlet shroud 15 to a transition piece or distributor 16 in the casting position. From the distributor 16, the molten metal flows to the delivery nozzle 17 positioned between the casting rolls 12 above the nip 18.

The casting rolls 12 are internally water cooled so that as the casting rolls 12 are counter-rotated, shells solidify on the casting surfaces 12A as the casting surfaces 12A move into contact with and through the casting pool 19 with each revolution of the casting rolls 12. The shells are brought together at the nip 18 between the casting rolls 12 to produce a solidified thin cast strip product 21 delivered downwardly from the nip 18. The gap between the casting rolls is such as to maintain separation between the solidified shells at the nip so that semi-solid metal is present in the space between the shells through the nip, and is, at least in part, subsequently solidified between the solidified shells within the cast strip below the nip.

FIG. 1 shows the twin roll caster producing the thin cast strip 21, which passes across a guide table 30 to a pinch roll stand 31, comprising pinch rolls 31A. Upon exiting the pinch roll stand 31, the thin cast strip may pass through a hot rolling mill 32, comprising a pair of work rolls 32A, and backup rolls 32B, forming a gap capable of hot rolling the cast strip delivered from the casting rolls, where the cast strip is hot rolled to reduce the strip to a desired thickness, improve the strip surface, and improve the strip flatness. The work rolls 32A have work surfaces relating to the desired strip profile across the work rolls. The hot rolled cast strip then passes onto a run-out table 33, where it may be cooled by contact with a coolant, such as water, supplied via water jets 90 or other suitable means, and by convection and radiation. In any event, the hot rolled cast strip may then pass through a second pinch roll stand 91 to provide tension of the cast strip, and then to a coiler 92. The cast strip may be between about 0.3 and 2.0 millimeters in thickness before hot rolling.

At the start of the casting campaign, a short length of imperfect strip is typically produced as casting conditions stabilize. After continuous casting is established, the casting rolls are moved apart slightly and then brought together again to cause this leading end of the cast strip to break away forming a clean head end of the following cast strip. The imperfect material drops into a scrap receptacle 26, which is movable on a scrap receptacle guide. The scrap receptacle 26 is located in a scrap receiving position beneath the caster and forms part of a sealed enclosure 27 as described below. The enclosure 27 is typically water cooled. At this time, a water-cooled apron 28 that normally hangs downwardly from a pivot 29 to one side in the enclosure 27 is swung into position to guide the clean end of the cast strip 21 onto the guide table 30 that feeds it to the pinch roll stand 31. The apron 28 is then retracted back to its hanging position to allow the cast strip 21 to hang in a loop beneath the casting rolls in enclosure 27 before it passes to the guide table 30 where it engages a succession of guide rollers.

An overflow container 38 may be provided beneath the movable tundish 14 to receive molten material that may spill from the tundish. As shown in FIG. 1, the overflow container 38 may be movable on rails 39 or another guide such that the overflow container 38 may be placed beneath the movable tundish 14 as desired in casting locations. Additionally, an overflow container (not shown) may be provided for the distributor 16 adjacent the distributor 16.

The sealed enclosure 27 is formed by a number of separate wall sections that fit together at various seal connections to form a continuous enclosure wall that permits control of the atmosphere within the enclosure. Additionally, the scrap receptacle 26 may be capable of attaching with the enclosure 27 so that the enclosure is capable of supporting a protective atmosphere immediately beneath the casting rolls 12 in the casting position. The enclosure 27 includes an opening in the lower portion of the enclosure, lower enclosure portion 44, providing an outlet for scrap to pass from the enclosure 27 into the scrap receptacle 26 in the scrap receiving position. The lower enclosure portion 44 may extend downwardly as a part of the enclosure 27, the opening being positioned above the scrap receptacle 26 in the scrap receiving position. As used in the specification and claims herein, "seal," "sealed," "sealing," and "sealingly" in reference to the scrap receptacle 26, enclosure 27, and related features may not be a complete seal so as to prevent leakage, but rather is usually less than a perfect seal as appropriate to allow control and support of the atmosphere within the enclosure as desired with some tolerable leakage.

A rim portion 45 may surround the opening of the lower enclosure portion 44 and may be movably positioned above the scrap receptacle, capable of sealingly engaging and/or attaching to the scrap receptacle 26 in the scrap receiving position. The rim portion 45 may be movable between a sealing position in which the rim portion engages the scrap receptacle, and a clearance position in which the rim portion 45 is disengaged from the scrap receptacle. Alternately, the caster or the scrap receptacle may include a lifting mechanism to raise the scrap receptacle into sealing engagement with the rim portion 45 of the enclosure, and then lower the scrap receptacle into the clearance position. When sealed, the enclosure 27 and scrap receptacle 26 are filled with a desired gas, such as nitrogen, to reduce the amount of oxygen in the enclosure and provide a protective atmosphere for the cast strip.

The enclosure 27 may include an upper collar portion supporting a protective atmosphere immediately beneath the casting rolls in the casting position. When the casting rolls 12 are in the casting position, the upper collar portion is moved to the extended position closing the space between a housing portion adjacent the casting rolls 12, as shown in FIG. 2, and the enclosure 27. The upper collar portion may be provided within or adjacent the enclosure 27 and adjacent the casting rolls, and may be moved by a plurality of actuators (not shown) such as servo-mechanisms, hydraulic mechanisms, pneumatic mechanisms, and rotating actuators.

Figure 4:
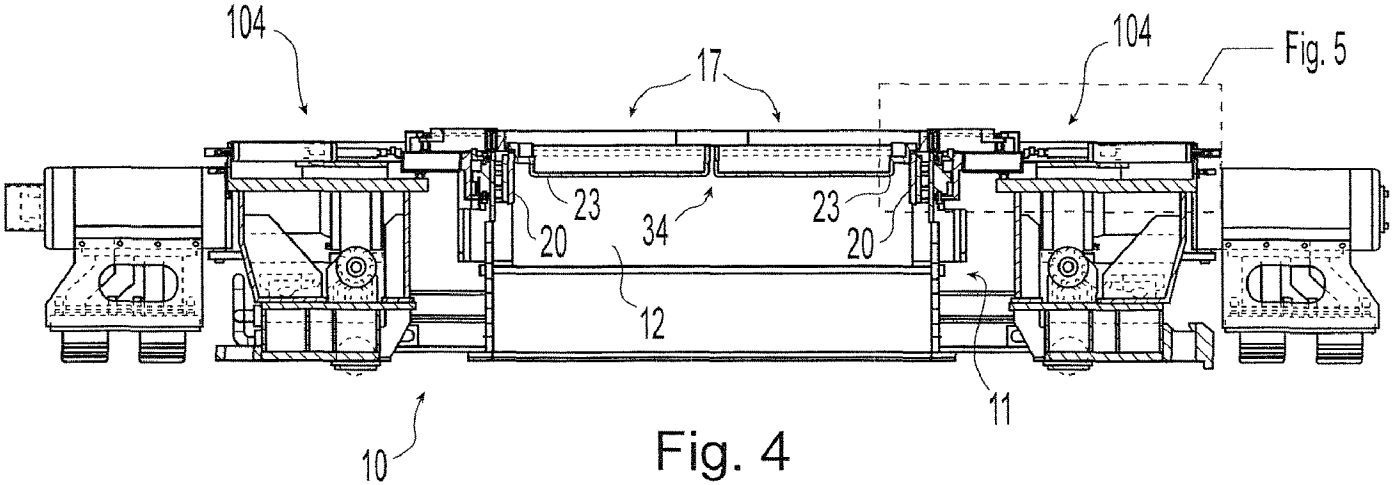
FIG. 4 is a transverse partial sectional view through the portion marked 4-4 in FIG. 3.

There is shown in FIG. 4 a pair of delivery nozzles 17 formed as substantially identical segments made of a refractory material such as zirconia graphite, alumina graphite or any other suitable material. It must be understood that more than two delivery nozzles 17 may be used in any different sizes and shapes if desired. The delivery nozzles 17 need not be substantially identical in size and shape, although generally such is desirable to facilitate fabrication and installation. Two delivery nozzles 17 may be provided, each capable of moving independently of the other above the casting rolls 12.

Typically where two delivery nozzles 17 are used the nozzles 17 are disposed and supported in end-to-end relationship along the nip 18 with a gap 34 therebetween, so that each delivery nozzle 17 can be moved inwardly toward each other during a casting campaign as explained below. It must be understood, however, that any suitable number of delivery nozzles 17 may be used, including two delivery nozzles 17 as described below and including any additional number of nozzles 17 disposed therebetween. For example, there may be a central nozzle segment adjacent to outer nozzle segments on either side.

Each delivery nozzle 17 may be formed in one piece or multiple pieces. As shown, each nozzle 17 includes an end wall 23 positioned nearest a confining side dam 20 as explained below. Each end wall 23 may be configured to achieve a particular desired molten metal flow in the triple point region between the casting rolls 12 and the respective side dam 20.

The side dams 20 may be made from a refractory material such as zirconia graphite, graphite alumina, boron nitride, boron nitride-zirconia, or other suitable composites. The side dams 20 have a face surface capable of physical contact with the casting rolls and molten metal in the casting pool.

Figure 5:
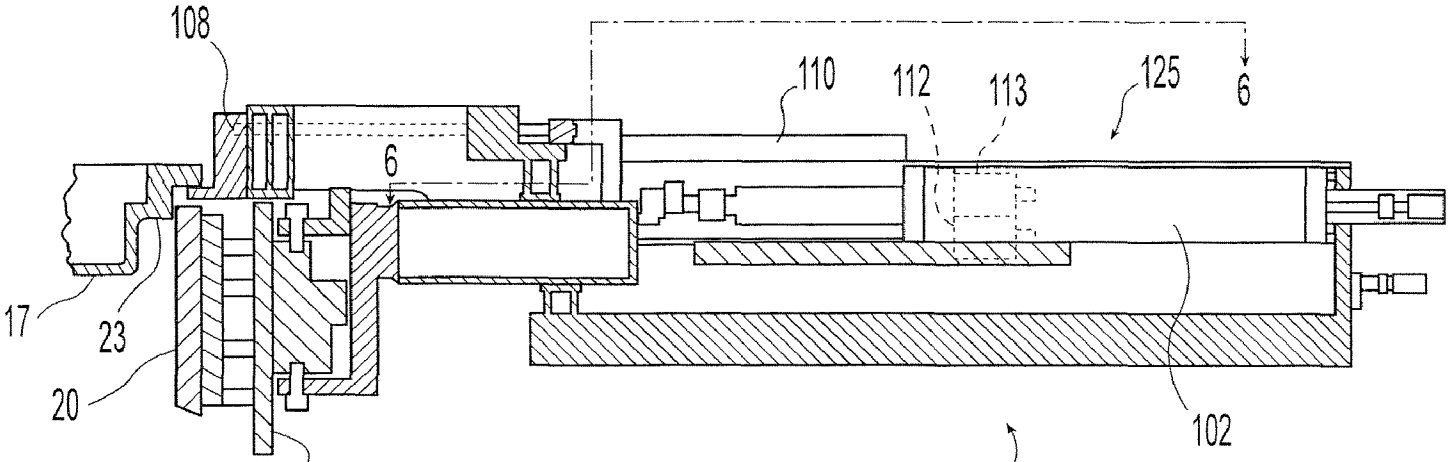
FIG. 5 is an enlarged view of one of the carriage assemblies marked as detail 5 in FIG. 4.
Figure 6:
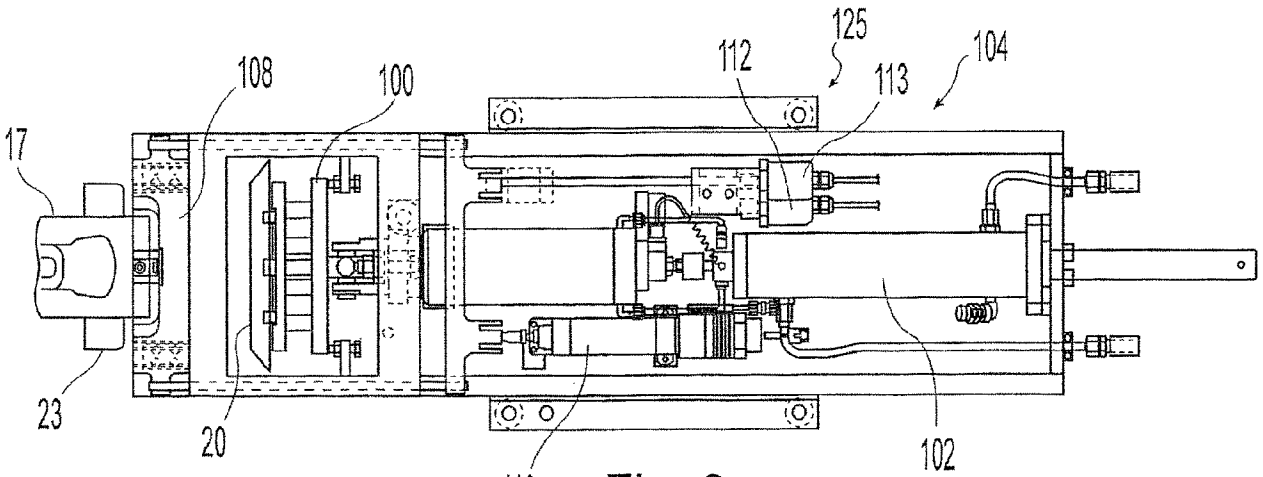
FIG. 6 is a plan view, partially in section, of the carriage assembly of FIG. 5 with the side dam in a first position.
Figure 7:
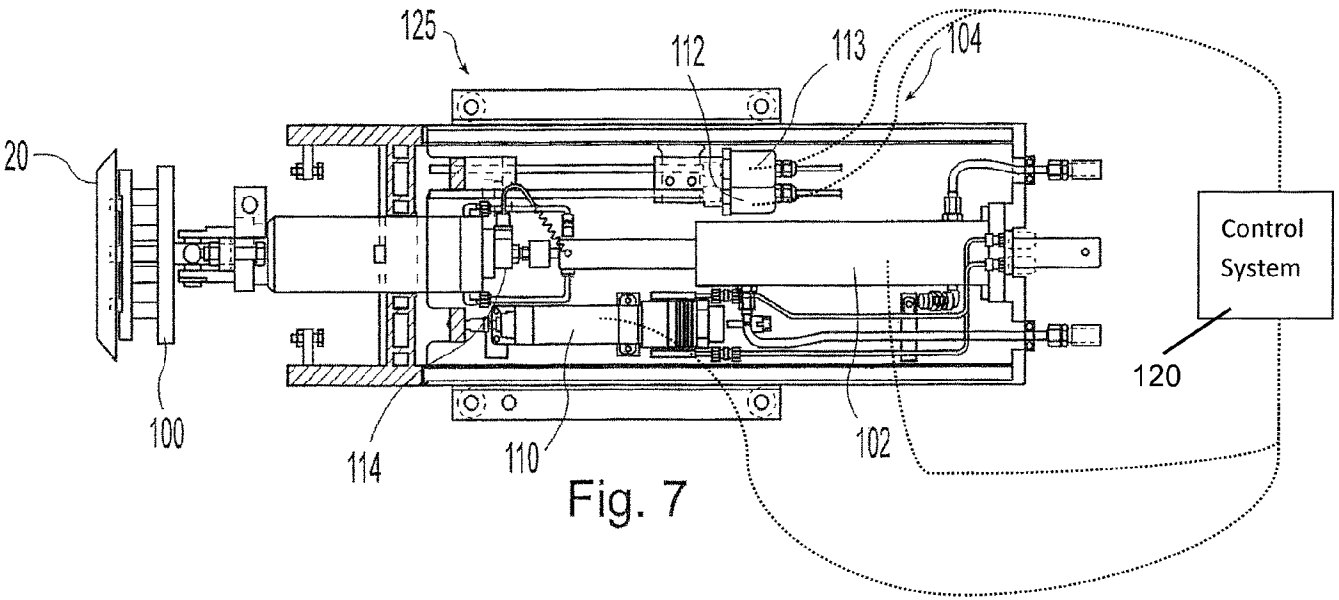
FIG. 7 is a view similar to FIG. 6 with the side dam in a second position.

A pair of carriage assemblies, generally indicated at 104, are provided to position the side dams 20 and the delivery nozzles 17. As illustrated, the twin roll caster is generally symmetrical, although such is not required. Referring to FIGS. 5-7, one carriage assembly 104 is illustrated and described below, with the other carriage assembly 104 being generally similar. It is understood that the twin roll caster may utilize any number of carriage assemblies 104 configured in any suitable manner to provide a flow of molten metal to the casting pool 19. Each carriage assembly 104 is disposed at one end of the pair of casting rolls 12. Each carriage assembly 104 may be mounted fixed relative to the machine frame 10, or may be moveable axially toward and away from the casting rolls 12 to enable the spacing between the carriage assembly 104 and the casting rolls 12 to be adjusted. The carriage assemblies 104 may be preset in final position before a casting campaign to suit the width of the casting rolls 12 for the strip to be cast, or the position of the carriage assembly 104 may be adjusted as desired during a casting campaign. The carriages 104 may be positioned one at each end of the roll assembly and moveable toward and away from one another to enable the spacing between them to be adjusted. The carriages can be preset before a casting operation according to the width of the casting rolls and to allow quick roll changes for differing strip widths. The carriages 104 may be positioned so as to extend horizontally above the casting rolls with the nozzles 17 positioned beneath the distributor 16 in the casting position and at a central position to receive the molten metal.

For example the carriage assembly 104 may be positioned from tracks (not shown) on the machine frame 10, which may be mounted by clamps or any other suitable mechanism. Alternatively, the carriage assembly 104 may be supported by its own support structure relative to the casting rolls 12.

The carriage assembly 104 includes a support frame 125. A nozzle bridge 108 is moveably connected to the support frame 125 and engages the delivery nozzles 17 for selective movement thereof. A nozzle actuator 110 is mounted to the support frame 125 and connected to the nozzle bridge 108 for moving the nozzle bridge 108 and thus moving the delivery nozzles 17 to position the end wall 23 relative to the side dam 20. The nozzle actuator 110 is thus capable of positioning the delivery nozzles 17. The nozzle actuator 110 is a conventional servo mechanism. It must be understood, however, that the nozzle actuator 110 may be any drive mechanism suitable to move and adjust delivery nozzles 17. For example, the nozzle actuator 110 may be a screw jack drive operated by an electric motor, a hydraulic mechanism, a pneumatic mechanism, a gear mechanism, a cog, a drive chain mechanism, a pulley and cable mechanism, a drive screw mechanism, a jack actuator, a rack and pinion mechanism, an electro-mechanical actuator, an electric motor, a linear actuator, a rotating actuator, or any other suitable device.

A nozzle position sensor 113 senses the position of the delivery nozzles 17. The nozzle position sensor 113 is a linear displacement sensor to measure the change in position of the nozzle bridge 108 relative to the support frame 125. The nozzle position sensor 113 may be any sensor suitable to indicate any parameter representative of a position of the delivery nozzles 17. For example, the nozzle position sensor 113 may be a linear variable displacement transformer to respond to the extension of the nozzle actuator 110 to provide signals indicative of movement of the delivery nozzles 17, or an optical imaging device for tracking the position of the delivery nozzles 17 or any other suitable device for determining the location of the delivery nozzles 17.

The side dam 20 is mounted to a plate holder 100 which is moveably connected to the support frame 125 and engages the side dam 20 for selective movement thereof. A side dam actuator 102 is mounted to the support frame 125 and connected to the plate holder 100 for moving the plate holder 100 and thus moving each side dam 20 to position the side dam 20 relative to the casting rolls 12. The side dam actuator 102 is thus capable of positioning the side dam 20 and capable of cyclically varying the axial force of the side dams as described below. The side dam actuator 102 is a hydraulic force cylinder. It must be understood, however, that the side dam actuator 102 may be any suitable drive mechanism to position the plate holder 100 to bring the side dam 20 into engagement with the casting rolls 12 to confine the casting pool 19 formed on the casting surfaces 12A during a casting operation. Such a suitable drive mechanism, for example, may be a servo mechanism, a screw jack drive operated by electric motor, a pneumatic mechanism, a gear mechanism, a cog, a drive chain mechanism, a pulley and cable mechanism, a drive screw mechanism, a jack actuator, a rack and pinion mechanism, an electro-mechanical actuator, an electric motor, a linear actuator, a rotating actuator, or any other suitable device. Thus, the side dams 20 are mounted in side dam plate holders 100, which are movable by side dam actuators 102, such as a servo mechanism, to bring the side dams 20 into engagement with the ends of the casting rolls. Additionally, the side dam actuators 102 are capable of positioning the side dams 20 during casting. The side dams 20 thus form end closures for the molten pool of metal on the casting rolls during the casting operation.

A side dam position sensor 112 senses the position of the side dam 20. The side dam position sensor 112 is a linear displacement sensor to measure the actual change in position of the plate holder 100 relative to the support frame 125. The side dam position sensor 112 may be any sensor suitable to indicate any parameter representative of a position of the side dam 20. For example, the side dam position sensor 112 may be a linear variable displacement transducer to respond to the extension of the side dam actuator 102 to provide signals indicative of position of the side dam 20, or an optical imaging device for tracking the position of the side dam 20 or any other suitable device for determining the location of the side dam 20. The side dam position sensor 112 may also or alternatively include a force sensor, or load cell for determining the force urging the side dam 20 against the casting rolls 12 and providing electrical signals indicative of the force urging the side dam against the casting rolls.

In any case the actuators 110 and 102 and the sensors 113 and 112 may be connected into a control system 120 in the form of a circuit receiving control signals determined by measurement of the distance variation between the delivery nozzles 17 and the confining side dams 20, and between the side dams 20 and the casting rolls 12. For example, small water cooled video cameras may be installed on the nozzle bridge 108, or any other suitable structure, to directly observe the distance between the delivery nozzles 17 and the confining side dams 20 and the side dams 20 and the casting rolls 12, and to produce control signals to be fed to position encoders on the actuators 110 and 102. With any arrangement, precise control of the distance between the end walls 23 of the delivery nozzle 17 and the side dams 20 and the casting rolls 12 may be maintained. Moreover these distances can be accurately set and maintained by independent operation of the actuators 110 and 102 during casting. For example, the distance between the end wall 23 and the side dam 20 may be set so that a discharge of molten metal is positioned to a target area on the side dam 20 relative to the triple point regions.

During a casting campaign the control system of the twin roll caster is capable of actuating the side dam actuators 102 to vary the apply force on the side dams 20 against the ends of the casting rolls 12 in the axial direction, i.e. along the axis of the centerlines of the two casting rolls. The apply force is not varied such that the side dams 20 develop a clearance at edges of the casting rolls 12 that may cause leakage of molten metal from the casting pool. The control system may receive position or force information from the sensors 112 or from direct feedback of the actuator 102.

In operation the axial force on the side dams 20 against the casting rolls 12 may be constant or varied on a cyclic basis of at least 0.5 Hz. The frequency of the variable force may at least 0.5 Hz, or at least 1 Hz, or at least 3 Hz, or at least 5 Hz, or at least 9 Hz or more. The variable force on the side dams may have an amplitude of plus or minus 120.0 Newtons (N), or about plus or minus 26.0 lbs, around a set point or mean force of 550 N, or about 121 lbs. It must be understood that the mean apply force may be set at any desirable point, so long as the casting pool remains confined between the casting rolls 12 and the side dams 20 or casting rolls 12 are not damaged or bound-up. The frequency rate of the varying apply force on the side dams may be varied, or modulated, or, as shown in FIG. 8, the apply force may be varied at a constant frequency.

Figure 8:
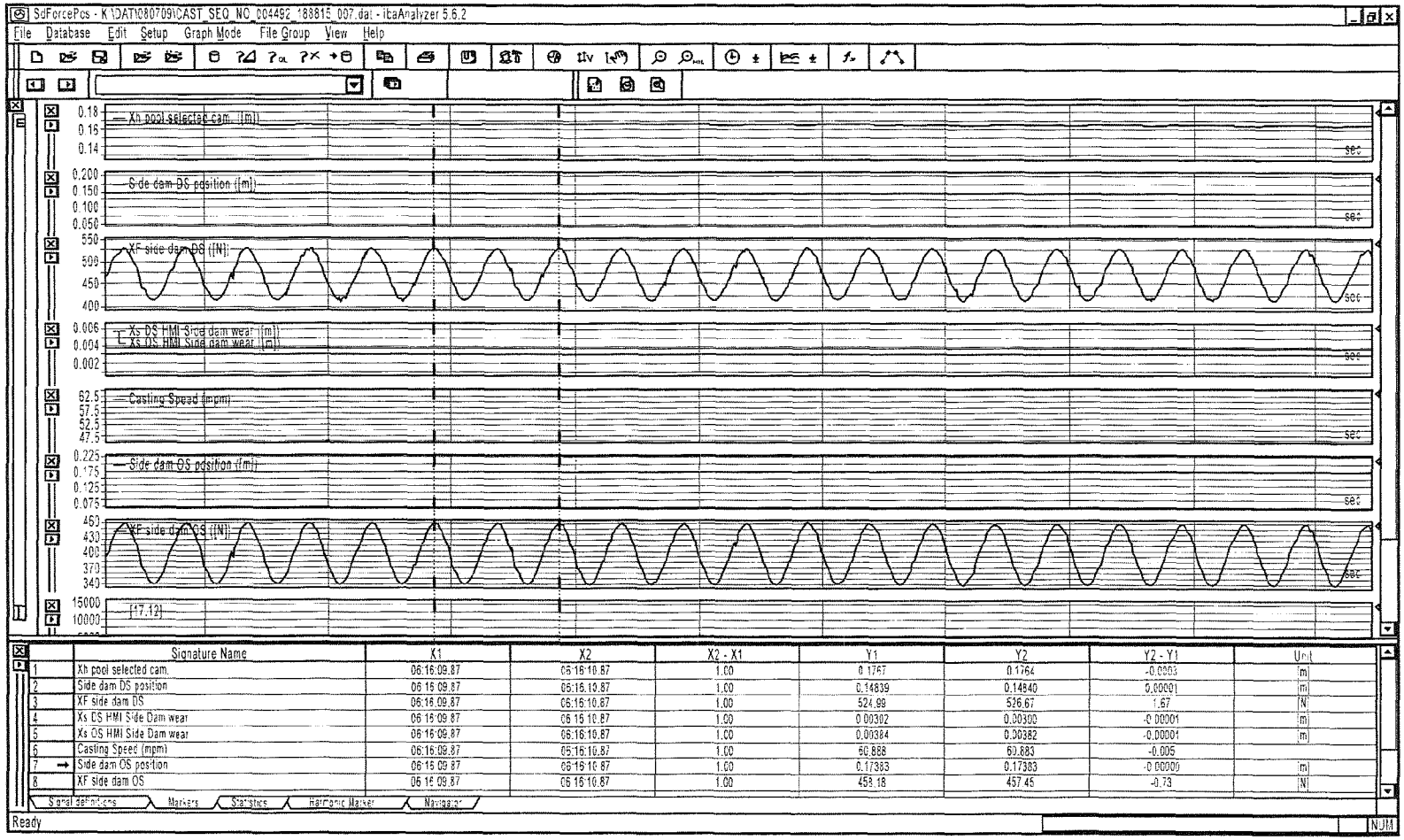
FIG. 8 shows the varied apply force of the side dams during a casting campaign with a caster similar to that shown in FIGS. 1 through 7.

As illustrated in FIG. 8, the apply force on both side dams 20 is being cyclically varied by the control system and side dam actuators 102 at a constant frequency cycle rate of 2 Hz. The control system may vary the apply force on the side dams, for example, at a cycle rate of at least 0.5 Hz, 1 Hz, 3 Hz, 5 Hz, 9 Hz or even more. Again, alternatively, the control system may vary, or modulate, the cycle rate on the axial force variation at an uneven rate.

As illustrated in FIG. 8, the apply force on one side dam is being varied from a mean force of about 470 N by plus or minus about 56 N, or about 11.9%, between about 414 N and about 526 N. The amplitude of the force on the other side dam is being varied from a mean force of about 400 N by about plus or minus 58 N, or about 14.5%, between about 342 N and 458 N. Additionally, for further example, the control system may vary the apply force on the side dams by more than plus or minus 10% of the mean force, so long as the apply force is varied without leakage of the casting pool. Also, the control system may vary the apply force on the side dams by less than plus or minus 60 N, 10 N, or even less. Further, the control system may vary, or modulate, the amplitude, or total amount of force variation on the side dams as desired, so long as the apply force minimum is not below the force necessary to confine the casting pool and so long as the apply force maximum is not above the force that damages the side dam or casting rolls or surpasses the stiction limit and binds up the twin roll caster.

Over the casting campaign the side dams 20 will experience significant wear. With the presently described apparatus and method, the distance between the nozzle end walls 23 and the confining plate side dams 20 may be set before casting and then the position of each of the end walls 23 and the side dams 20 adjusted separately and independently of one another, while the axial force on the side dams is cyclically varied. Thus, the desired distance between the side dams 20 and the ends of the delivery nozzles 17 may be maintained during the casting campaign.

Moreover, the side dams 20 wear only at their margins which engage the end faces of the casting rolls 12. The inner parts of the confining side dams 20 between these margins wears at a substantially lower rate. As wear of the side dams 20 continues they are projected inwardly along the ends of the casting rolls 12 decreasing the distance between the confining plates and the outer nozzle ends. The varied apply force of the side dams 20 provided by the present invention allows for improved side dam control of the side dams 20, and reduced wear on the side dams 20 and extend useful life of the side dams 20, as there is reduced contact between the side dam 20 and the ends of the casting rolls 12 than is the case at the higher magnitude forces.

By the apparatus and method described above, the twin roll caster experiences less bind up due to mechanical stiction by varying the side dam apply force. Moreover, we have found that by varying the axial force on the side dams, rather than maintaining a constant apply force, side dam wear is reduced by up to about 20% due to the side dam, surprisingly, experiencing a larger reduction in wear because of the lower force on the side dams.

Figure 9:
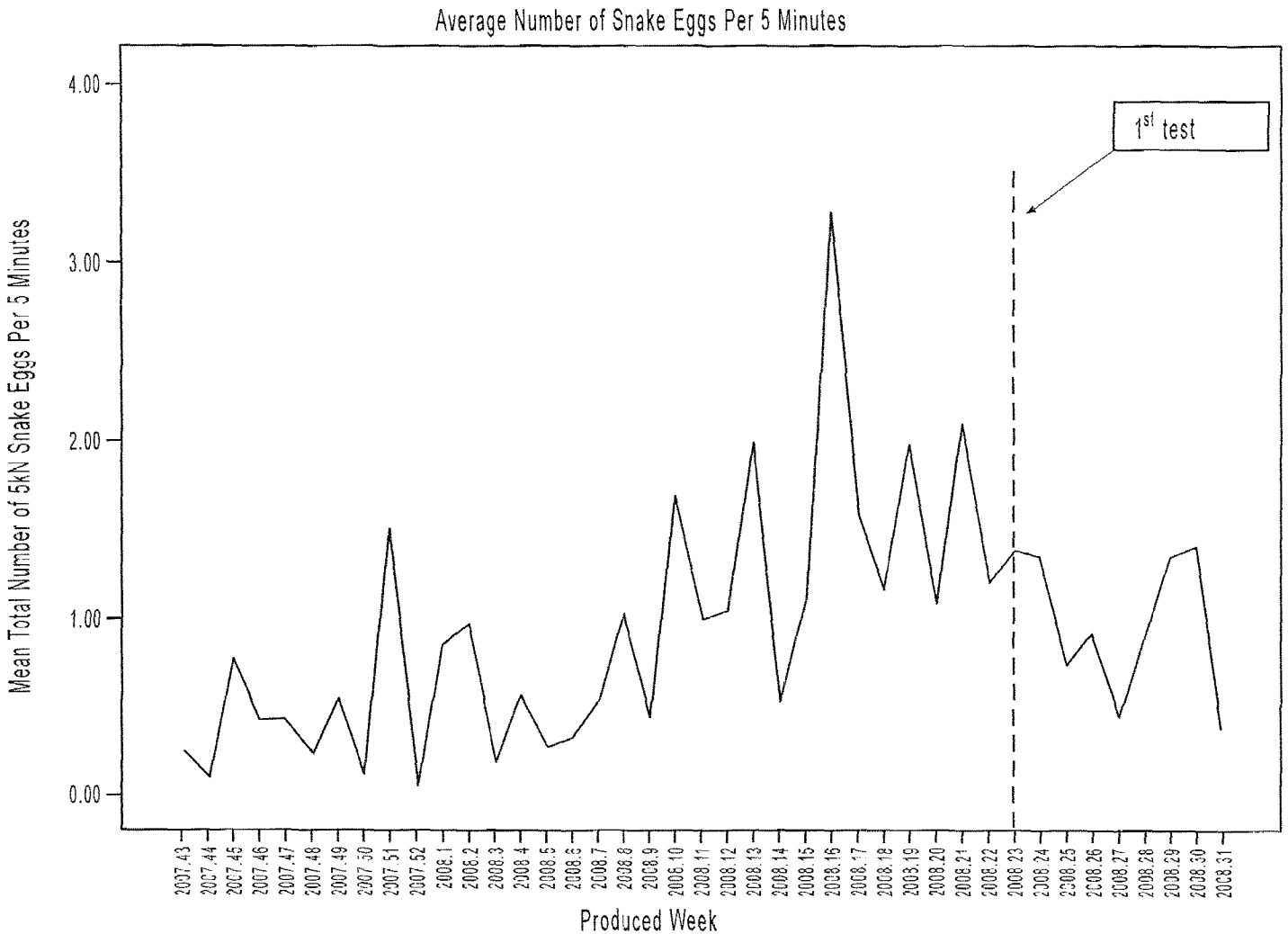
FIG. 9 shows the number of snake eggs per five minutes of casting with a twin-roll caster similar to that shown in FIGS. 1 through 7, with a constant apply force by the side dams and a cyclically varied axial force on the side dams during a casting campaign.

Further, it is possible to achieve more accurate, smoother control of the distance between the nozzle and the side dam with a varied apply force than without. As a result, it is possible to more effectively control triple point pouring which, in conjunction with the increased side dam temperature (from less contact pressure with the rolls) reduces the incidence of formation of snake eggs. As shown in FIG. 9, the average number of snake eggs per five minute interval was in the past generally increasing through a casting campaign, until a cyclical axial force was implemented, as described above, and the trend for the average number of snake eggs per five minute interval began decreasing. The portion of time of cyclical axial force also provided a lower average total occurrence of snake eggs as compared to all time without application of cyclic axial force.

The size of snake eggs may vary during a casting campaign. As snake eggs pass through the nip they may act against the rolls creating transverse forces. One measure of the size of snake eggs is the amount of transverse force between the rolls as a snake egg passes through the nip. Typically, the larger the snake egg, the larger the transverse force on the casting rolls. Two measurements for snake eggs detection are 2 kN (kilo-Newton) and 5 kN transverse force increases as detected by a load cell on the casting roll on the delivery side of the twin-roll caster.

Figure 10:
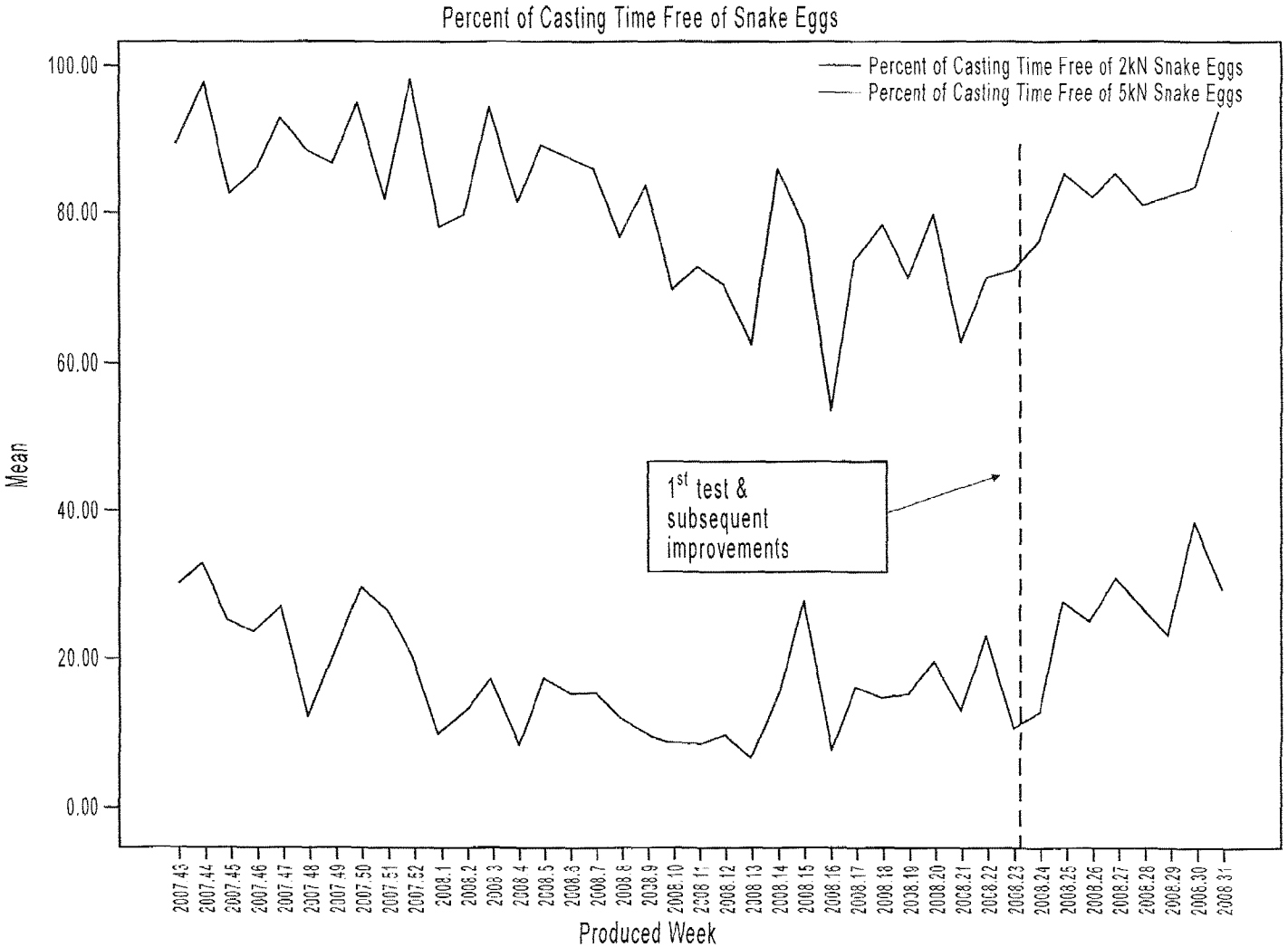
FIG. 10 shows the percent of casting time free of snake eggs when casting with a caster similar to that shown in FIGS. 1 through 7, with a constant apply force on the side dams and a cyclically varied apply force on the side dams during a casting campaign

FIG. 10 illustrates the percent of casting time free of 2 kN snake eggs and 5 kN snake eggs. The total time free of 2 kN and 5 kN snake eggs were both generally decreasing through a casting campaign, until a cyclical axial force was implemented, as described above. The trend for the total time free of 2 kN and 5 kN snake eggs also both began increasing with the application of cyclical axial force on the side dams. The portion of time of variation of apply force also has an overall higher average of total free time free of 2 kN and 5 kN snake eggs as compared to all time without variation of apply force. The side dams tend to be hotter with less overall force between the side dams and casting rolls, because of less heat conduction between the side dams and casting rolls. Due to the increased time with lower applied forces, it is expected that the side dams will have relatively higher temperature which would tend to decrease the formation of snake eggs.

While the principle and mode of operation of this invention have been explained and illustrated with regard to particular embodiments, it must be understood, however, that this invention may be practiced otherwise than as specifically explained and illustrated without departing from its spirit or scope.

What is claimed is:

1. Apparatus for continuously casting metal strip comprising:

(a) a pair of counter-rotatable casting rolls laterally positioned to form a nip therebetween through which thin strip is cast;

(b) a pair of confining side dams adjacent the ends of the casting rolls operable to confine a casting pool of molten metal supported on the casting rolls and formed on casting surfaces above the nip;

(c) a metal delivery system disposed above the nip and operable to discharge molten metal to form the casting pool supported on the casting rolls;

(d) side dam actuators each operable to apply cyclical axial force of a desired cycle rate to the side dams without leakage; and (e) a control system adapted to actuate at least one side dam actuator to cyclically vary the apply force of the side dam against the ends of the casting rolls during a casting campaign.

2. The apparatus of claim 1 where the control system is operable to actuate the side dam actuator to cyclically vary the apply force at a cycle rate of at least 0.5 Hz.

3. The apparatus of claim 2 where the control system is operable to actuate the side dam actuator to cyclically vary the apply force at a cycle rate of at least 1 Hz.

4. The apparatus of claim 3 where the control system is operable to actuate the side dam actuator to cyclically vary the apply force at a cycle rate of at least 3 Hz.

5. The apparatus of claim 4 where the control system is operable to actuate the side dam actuator to cyclically vary the apply force at a cycle rate of at least 5 Hz.

6. The apparatus of claim 5 where the control system is operable to actuate the side dam actuator to cyclically vary the apply force at a cycle rate of at least 9 Hz.

7. The apparatus of claim 1 where the control system is operable to actuate the side dam actuator to cyclically vary the apply force at least plus or minus 10% of the mean apply force.

8. The apparatus of claim 1 where the control system is operable to actuate the side dam actuator to cyclically vary the apply force less than plus or minus 120 N.

9. The apparatus of claim 8 where the control system is operable to actuate the side dam actuator to cyclically vary the apply force less than plus or minus 10 N.

10. The apparatus of claim 1 where the control system is operable to vary the rate of the cyclic force applied to the side dam at least once during a campaign.

11. A method of continuously casting metal strip comprising steps:

(a) assembling a pair of counter-rotatable casting rolls to form a nip therebetween through which thin strip is cast, and a pair of confining side dams adjacent the ends of the casting rolls operable to confine a casting pool of molten metal supported on casting rolls and formed on casting surfaces above the nip;

(b) assembling a metal delivery system disposed above the nip and operable to discharge molten metal to form the casting pool supported on the casting rolls;

(c) assembling side dam actuators each operable to cause cyclic axial force of a desired cycle rate to be applied to the side dams during a campaign, and (d) controlling at least one of the side dam actuators to cyclically vary the force on the side dam against the ends of the casting rolls in a direction along the axes of rotation of the casting rolls without leakage during a casting campaign.

12. The method of claim 11 where the controlling in step (d) includes actuating the side dam actuator to cyclically vary the force at a cycle rate of at least 0.5 Hz.

13. The method of claim 12 where the controlling in step (d) includes actuating the side dam actuator to cyclically vary the force at a cycle rate of at least 1 Hz.

14. The method of claim 13 where the controlling in step (d) includes actuating the side dam actuator to cyclically vary the force at a cycle rate of at least 3 Hz.

15. The method of claim 14 where the controlling in step (d) includes actuating the side dam actuator to cyclically vary the force at a cycle rate of at least 5 Hz.

16. The method of claim 15 where the controlling in step (d) includes actuating the side dam actuator to cyclically vary the force at a cycle rate of at least 9 Hz

17. The method of claim 11 where the controlling in step (d) includes actuating the side dam actuator to cyclically vary the force at least plus or minus 10% of the mean force.

18. The method of claim 11 where the controlling in step (d) includes actuating the side dam actuator to cyclically vary the axial force less than plus or minus 120 N.

19. The method of claim 18 where the controlling in step (d) includes actuating the side dam actuator to cyclically vary the axial force less than plus or minus 10 N.

20. The method of claim 11 where the control system is operable to vary the cycle rate of the cyclic axial force to the side dam during a campaign.

* * * * *

UNITED STATES PATENT AND TRADEMARK OFFICE

CERTIFICATE OF CORRECTION

PATENT NO. : 8,028,741 B2
APPLICATION NO. : 12/266206
DATED : October 4, 2011
INVENTOR(S) : Rees et al.

It is certified that error appears in the above-identified patent and that said Letters Patent is hereby corrected as shown below:

Column 8, line 58, “may at” should read --may be at--.

Signed and Sealed this
Twentieth Day of March, 2012

David J. Kappos

David J. Kappos
*Director of the United States Patent and Trademark Office*